United States Patent [19]

Sprinkel Jr.

[11] Patent Number: 4,869,276

[45] Date of Patent: Sep. 26, 1989

[54] HINGED FILTER SLEEVE

[75] Inventor: Francis M. Sprinkel Jr., Glen Allen, Va.

[73] Assignee: Philip Morris Incorporated, New York, N.Y.

[21] Appl. No.: 89,445

[22] Filed: Aug. 26, 1987

[51] Int. Cl.[4] ..... A24D 3/04

[52] U.S. Cl. ..... 131/361; 131/336

[58] Field of Search ..... 131/336, 342, 365, 361, 131/362

[56] References Cited

U.S. PATENT DOCUMENTS

| | | | |
|---|---|---|---|
| 973,890 | 10/1910 | Surbrug . | |
| 2,226,473 | 12/1940 | Kennedy . | |
| 2,881,770 | 4/1959 | Touey | 131/342 |
| 3,189,032 | 6/1965 | Brothers . | |
| 3,205,791 | 9/1965 | Goodfellow et al. . | |
| 3,490,461 | 1/1970 | Osmalov et al. . | |
| 3,524,450 | 8/1970 | Molins . | |
| 4,256,122 | 3/1981 | Johnson | 131/336 |
| 4,498,487 | 2/1985 | Frattolillo . | |
| 4,542,754 | 9/1985 | Cantrell et al. . | |
| 4,553,556 | 11/1985 | Lephardt . | |
| 4,582,071 | 4/1986 | Westcott et al. . | |
| 4,614,199 | 9/1986 | Berger | 131/336 |
| 4,620,557 | 11/1986 | Cantrell et al. . | |
| 4,637,409 | 1/1987 | Berger | 131/336 |
| 4,646,762 | 3/1987 | Riehl et al. . | |
| 4,649,942 | 3/1987 | Horsewell et al. | 131/336 |

FOREIGN PATENT DOCUMENTS

| | | |
|---|---|---|
| 1027901 | 5/1953 | France . |
| 1110914 | 4/1968 | United Kingdom . |

*Primary Examiner*—V. Millin

*Attorney, Agent, or Firm*—Eric M. Lee

[57] ABSTRACT

A filter cigarette is provided with a filter assembly having a substantially tubular sleeve with at least one hinge formed in the periphery of the substantially tubular sleeve. The hinge causes the sleeve to be resilient in the radial direction which allows the sleeve diameter to decrease and increase so that the radii of the tobacco rod and filter assembly can be properly matched and the tipping materail can be tightly wrapped around the filter assembly.

6 Claims, 1 Drawing Sheet

HINGED FILTER SLEEVEBACKGROUND OF THE INVENTION

This invention relates to a filter cigarette having a filter assembly with a plastic filter sleeve. More particularly, this invention relates to a filter cigarette in which the diameter of the plastic sleeve can decrease and increase to prevent the occurrence of any gaps between the filter assembly and tipping material, to properly match the radii of the filter assembly and the tobacco rod, and to ensure proper air flow through ventilation air grooves, if any, in the filter sleeve.

In typical filter cigarettes a filter assembly is coaxially aligned with a cylindrical rod of smoking material such as tobacco. The filter assembly, which includes a wrapped filter tow, is connected to the tobacco rod by means of tipping material. This tipping material is tightly wrapped around the filter assembly and a portion of the tobacco rod, and is adhered to both. When tipping material is being wrapped around the filter assembly, the filter assembly, which is somewhat resilient, is compressed. Upon completion of the wrapping operation, the resilience of the filter assembly ensures that no gaps occur between the filter assembly and tipping material.

An example of one type of a filter cigarette is described in U.S. Pat. No. 3,490,461. The filter assembly of that cigarette includes a substantially tubular plastic sleeve into which wrapped tow is inserted. The filter sleeve has generally longitudinal ventilation air grooves in the periphery.

The filter sleeve described in the aboveidentified patent is substantially tubular and is formed, for example, from extruded thermoplastic material. Filter material such as cellulose acetate is typically used to fill the central section of the filter sleeve. Tipping material is wrapped around the filter assembly and a portion of the tobacco rod. In this manner the filter assembly is connected to one end of the tobacco rod.

Such a filter assembly does not wrap well with tipping material. It is difficult to wrap the tipping material tightly enough to prevent gaps from occurring between the extruded thermoplastic material and the tipping material. These gaps may occur with the extruded thermoplastic sleeve because such a sleeve does not have sufficient resiliency or flexibility to be compressed during wrapping with the tipping material and to subsequently spring back to ensure a tight wrap by the tipping material.

In addition, the radius of the sleeve varies from the extruder thus making it difficult to match the radius of the tobacco rod with the filter assembly.

It is undesirable to have a gap between the tipping material and the filter assembly because of the unsightly appearance of the resulting cigarette when viewed from the mouth end and, if longitudinal ventilation air grooves are used in the periphery of the filter sleeve, these gaps will adversely affect the air flow through the ventilation air grooves by allowing more air to flow through some grooves than through others.

It would be desirable to provide a filter cigarette having a filter assembly including a plastic sleeve that can be tightly wrapped with tipping material to eliminate gaps between the tipping material and the filter assembly.

It would also be desirable to provide a filter cigarette with a filter assembly radius that is closely matched to the radius of the tobacco rod.

SUMMARY OF THE INVENTION

It is an object of this invention to provide a filter cigarette having a filter assembly including a plastic sleeve that can be tightly wrapped with tipping material to eliminate gaps between the tipping material and the filter assembly.

It is another object of this invention to provide such a cigarette in which the radius of the filter assembly can be more closely matched to the radius of the tobacco rod.

In accordance with this invention, there is provided a filter cigarette with a filter assembly comprised of a substantially tubular plastic sleeve having a hinge means formed in its periphery, and tipping material circumscribing the tubular plastic sleeve and overlapping a portion of an elongated rod of smoking material.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which.

DETAILED DESCRIPTION OF THE INVENTION

Figure 1:
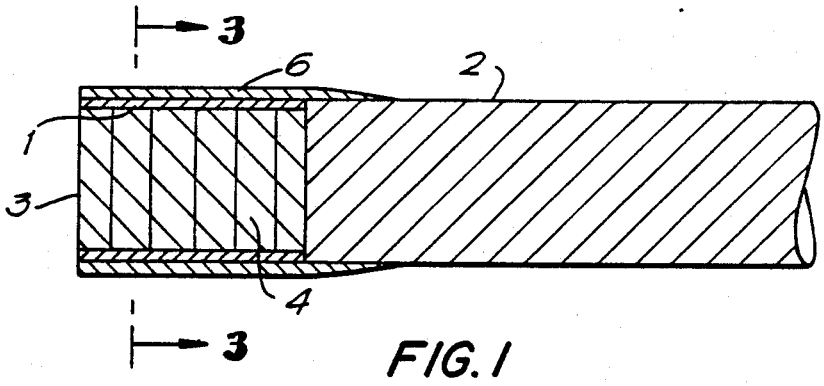
FIG. 1 is a longitudinal cross-sectional view of a filter cigarette of this invention.

Referring to FIG. 1, the tubular sleeve 1 is formed as a cylindrical body having substantially the same diameter as the tobacco rod 2. Sleeve 1 is coaxially located at one end of tobacco rod 2. Sleeve 1 has an inner passage 3 extending therethrough. A filter tow 4 is placed in inner passage 3 to provide a flow path for the smoke drawn from tobacco rod 2 and delivered to the smoker's mouth.

Sleeve 1 housing filter tow 4 may be made from a variety of materials and formed in a number of ways. For example, sleeve 1 can be made by extruding a tubular body of thermoplastic material of continuous length and then sectioning this material to provide individual sleeves. Suitable material includes thermosetting resins such as phenolics. Foamed polyurethane also can be used provided an air impervious film is applied to the external surface thereof, or the tubular sleeve can be made from an extruded bonded fibrous material.

Sleeve 1 can also be formed with a plurality of ventilation grooves in its peripheral surface extending generally longitudinally of sleeve 1.

Filter tow 4 may be of various substances, for example, a tow of cellulose acetate, a composite structure including a fiber tow and a granular filtrant such as charcoal or any other form of filter medium suited for the intended purpose.

Sleeve 1 is attached to tobacco rod 2 by tipping material 6 which circumscribes sleeve 1 and overlaps a portion of tobacco rod 2. Tipping material 6 can be impermeable or air permeable. If longitudinal ventilation grooves are used in the periphery of sleeve 1 a portion of tipping material 6 surrounding sleeve 1 can be air permeable over a portion of the ventilation grooves while the remainder of tipping material 6 is impermeable. If air permeable, tipping material 6 can be fabricated of an inherently porous material or be made air permeable by forming small perforations through the thickness of tipping material 6.

Figure 2:
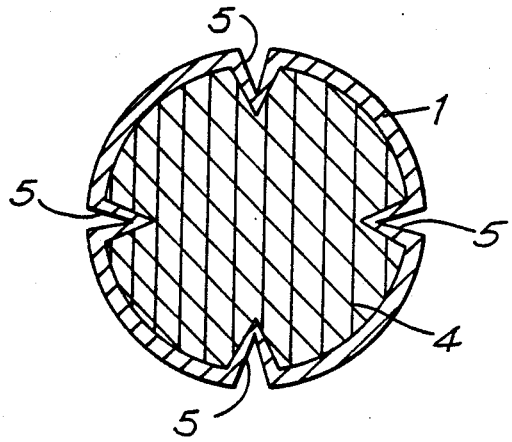
FIG. 2 is a transverse cross-sectional view of an unwrapped filter assembly of this invention, taken from line 3—3 of FIG. 1, showing the sleeve, filter tow and hinge means.

Referring now to FIG. 2, at least one large groove or notch 5 is formed in the peripheral surface of sleeve 1. Preferably two or four notches 5 are formed in the peripheral surface of sleeve 1. The number of notches 5 in the peripheral surface of sleeve 1 is limited by the structural integrity of sleeve 1. If too many notches 5 are used, sleeve 1 will become fragile and will not be able to hold its shape.

Notches 5 at the peripheral surface of sleeve 1 extend generally longitudinally of sleeve 1. Notches 5 act as hinges to allow the diameter of sleeve 1 to decrease and increase. Notches 5 can be made in any shape that will allow sleeve 1 to decrease and then increase in diameter. Preferably, notches 5 will be a "V shape". To ensure that notches 5 will act as hinges to open and close it is preferable that the thickness of the material of sleeve 1 be thinner near the apex of notches 5, to provide hinging action as in a flexural hinge.

Figure 3:
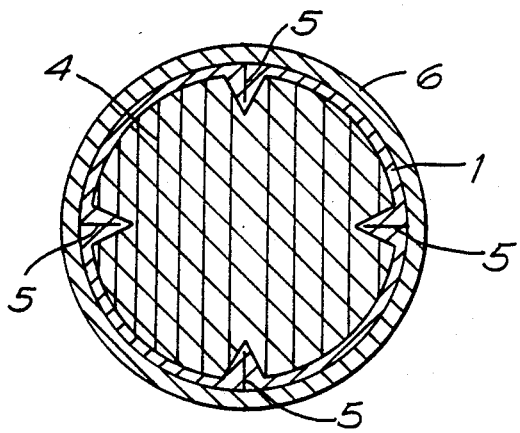
FIG. 3 is a transverse cross-sectional view of a wrapped filter assembly of this invention, taken from line 3—3 of FIG. 1, showing the tight fit of the tipping material created by the use of the hinge means in the periphery of the sleeve.

Tightly wrapping tipping material 6 around sleeve 1 causes pressure to be exerted on sleeve 1. Referring now to FIG. 3, notches 5 in the periphery of sleeve 1 allow the diameter of sleeve 1 to decrease under this pressure. As pressure is applied around sleeve 1 the sides of notches 5 tend to abut one another thereby decreasing the diameter of sleeve 1. Once tipping material 6 has been applied the resiliency and flexibility of sleeve 1, and notches 5 in particular, cause the sides of notches 5 to tend to move away from one another thereby tending to increase the diameter of the sleeve 1. The tendency of the diameter to increase causes tipping material 6 to become tightly wrapped around sleeve 1. Resilient filter tow 4 in the central portion of sleeve 1 also pushes against notches 5, thereby augmenting the resilience of sleeve 1. This ensures a tight fit between tipping material 6 and sleeve 1 and prevents the occurrence of gaps between sleeve 1 and tipping material 6.

The number of notches 5 used and the depth of each notch 5 is determined by choosing the proper combination to ensure a tight fit between the filter assembly and tipping material 6 with no gaps occurring between the filter assembly and tipping material 6, as well as to achieve a desired smoke flow pattern. The depth chosen for notches 5 depends on the number of notches 5 to be used and the smoke flow path through filter tow 4. A single deep notch 5 will allow as large a decrease and subsequent increase in the diameter of sleeve 1 as would a plurality of shorter notches 5. However, a single deep notch 5 will adversely affect the smoke flow path through filter tow 4 by forcing the smoke to flow through substantially one side of the cross section of filter tow 4. A plurality of shorter notches 5 would avoid this. Preferably, four notches, each having a depth of 1.0 millimeter to 2.5 millimeters, are provided, and are spaced equiangularly about the circumference of sleeve 1.

The use of notches 5 allows the diameter of sleeve 1 to vary to also provide for proper matching between the radii of sleeve 1 and tobacco rod 2.

Thus it is seen that a filter cigarette is provided having a filter assembly including a plastic sleeve that can be tightly wrapped with tipping material to eliminate gaps between the tipping material and the filter assembly to ensure an attractive appearance and proper air flow through any longitudinal ventilation air grooves if they are used and to properly match the radii of the plastic sleeve and the tobacco rod. One skilled in the art will appreciate that the present invention can be practiced by other than the described embodiments, which are presented for purposes of illustration and not of limitation, and the present invention is limited only by the claims which follow.

What is claimed is:

1. A cigarette comprising:

an elongated rod of smoking material;

a substantially tubular sleeve defining a central inner passage at one end of said elongated rod of smoking material;

flexural hinge means formed in the periphery of said substantially tubular sleeve, said flexural hinge means comprising at least one opening formed in the periphery of said substantially tubular sleeve to allow said flexural hinge means to open and close thereby changing the diameter of said substantially tubular sleeve; and tipping material circumscribing said substantially tubular sleeve and overlapping a portion of said elongated rod of smoking material.

2. The cigarette of claim 1 wherein said opening formed in the periphery of said substantially tubular sleeve is a V-shaped notch having an apex extending toward said central inner passage and legs connecting said apex with the periphery of said substantially tubular sleeve.

3. The cigarette of claim 2 wherein said V-shaped notch is thinner around the apex of said notch than along said legs of said notch.

4. The cigarette of claim 3, wherein said flexural hinge means comprises two such V-shaped notches.

5. The cigarette of claim 3, wherein said flexural hinge means comprises four such V-shaped notches.

6. The cigarette of any of claims 3, 4 or 5 wherein said V-shaped notch extends from about one millimeter to about two millimeters toward said central inner passage from the periphery of said substantially tubular sleeve.

* * * * *

UNITED STATES PATENT AND TRADEMARK OFFICE

CERTIFICATE OF CORRECTION

PATENT NO. : 4,869,276

DATED : September 26, 1989

INVENTOR(S) : Sprinkel, Francis M., Jr.

It is certified that error appears in the above-identified patent and that said Letters Patent is hereby corrected as shown below:

| | |
|---|---|
| Title Page: Abstract, line 9 | "materail" should be -- material -- |
| Column 1, line 1 | "HINGED FILTER SLEEVEBACKGROUND OF THE INVENTION" should be -- HINGED FILTER SLEEVE -- |
| Column 1, line 2 | Insert -- Background Of The Invention -- |
| Column 1, line 35 | "aboveidentified" should be -- above-identified -- |

Signed and Sealed this

Twenty-third Day of July, 1991

*Attest:*

*Attesting Officer*

HARRY F. MANBECK, JR.

*Commissioner of Patents and Trademarks*